US007431356B2

(12) United States Patent
Liang et al.

(10) Patent No.: US 7,431,356 B2
(45) Date of Patent: Oct. 7, 2008

(54) WINDOW VENT STOP

(75) Inventors: Luke K. Liang, Irvington, NJ (US); Tong Liang, Guangzhou (CN)

(73) Assignee: Vision Industries Group, Inc.

( * ) Notice: Subject to any disclaimer, the term of this patent is extended or adjusted under 35 U.S.C. 154(b) by 0 days.

(21) Appl. No.: 10/623,120

(22) Filed: Jul. 18, 2003

(65) Prior Publication Data

US 2005/0011131 A1 Jan. 20, 2005

(51) Int. Cl.
*E05C 3/12* (2006.01)

(52) U.S. Cl. ..... 292/219; 292/220; 292/226; 292/228; 292/DIG. 47; 49/449

(58) Field of Classification Search ..... 49/176, 49/449; 292/219, 220, 223, 226, 228, DIG. 15, 292/DIG. 46, DIG. 47, 224, DIG. 20, DIG. 37
See application file for complete search history.

(56) References Cited

U.S. PATENT DOCUMENTS

| | | | | | |
|---|---|---|---|---|---|
| 14,741 | A | * | 4/1856 | Anderson | 362/181 |
| 192,919 | A | * | 7/1877 | Hoyt | 292/228 |
| 516,592 | A | * | 3/1894 | Curl | 292/113 |
| 699,696 | A | * | 5/1902 | Mellen | 292/228 |
| 769,767 | A | * | 9/1904 | Phelps | 70/90 |
| 804,994 | A | * | 11/1905 | Andrews | 292/219 |
| 1,279,353 | A | * | 9/1918 | Kelly et al. | 292/219 |
| 1,485,382 | A | * | 3/1924 | Foley | 292/219 |
| 1,895,146 | A | * | 1/1933 | Brown | 292/228 |
| 2,138,251 | A | * | 11/1938 | Lindstrom et al. | 292/198 |
| 2,569,045 | A | * | 9/1951 | Endter | 292/229 |
| 2,682,424 | A | * | 6/1954 | Adams et al. | 292/336.3 |
| 3,805,322 | A | * | 4/1974 | Serrano | 16/82 |
| 4,103,945 | A | * | 8/1978 | Turman | 292/100 |
| 4,923,230 | A | * | 5/1990 | Simpson | 292/67 |
| 4,932,694 | A | * | 6/1990 | Cater, Sr. | 292/210 |
| 5,248,174 | A | * | 9/1993 | Matz et al. | 292/338 |
| 5,553,903 | A | * | 9/1996 | Prete et al. | 292/163 |
| 5,653,483 | A | * | 8/1997 | Grover | 292/194 |
| 5,755,582 | A | * | 5/1998 | Charlton | 439/131 |
| 5,806,900 | A | * | 9/1998 | Bratcher et al. | 292/137 |

* cited by examiner

*Primary Examiner*—Gregory J. Strimbu
(74) *Attorney, Agent, or Firm*—Thomas A. O'Rourke; Bodner & O'Rourke, LLP

(57) ABSTRACT

A window vent stop for use in a sliding sash window assembly or a sliding door assembly. The vent stop has a housing adapted to be disposed in a recess in a non-movable sash member. This housing includes a cavity with a bottom plate therein. A tumbler has at least one pivot for pivotally securing the tumbler to the housing for movement between an extended position, to prevent movement of the sliding sash member and a retracted position, to allow movement of the sliding sash member. Also within the housing is a spring for biasing the tumbler toward the extended position. The tumbler has a first locking member that contacts a second locking member on a release member when the tumbler is in the retracted position and the first locking member does not contact the second locking member when the tumbler is in the extended position.

18 Claims, 9 Drawing Sheets

WINDOW VENT STOP

FIELD OF THE INVENTION

The present invention relates to improved window vent stops particularly for double hung windows and the like and to improvements in their operation. These window vent stops are used to prevent a window or door from opening more than a desired amount.

BACKGROUND OF THE INVENTION

There are a number of different types of window vent stops available on the market. These window vent stops are used to restrict the opening of windows and doors. For example, a window may be opened only a portion due to security concerns or to increase comfort in the room. Window vent stops are primarily used on double hung windows and sliding doors where a sash or a door member slides from a first position to a second position. The window sash lock prevents the sash or the sliding door from moving past a selected point. These sash locks can permit the window to be opened a desired amount for ventilation or other purposes.

There are many different types of windows currently available. These windows include casement windows, transom windows, single hung windows, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. More recently, the windows including the window sashes have been made of extruded metal or plastic.

Single hung windows are similar in design to double hung windows except that there is only one sash that may be raised or lowered. Sliding windows are also not unlike double hung windows in design. While a double hung window has sashes that are raised and lowered, a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position. One such stop is shown in U.S. Pat. No. 5,248,174 owned by Ashland Products. Another sash stop is shown in U.S. Pat. No. 4,923,230 owned by Ro Mai. In each of these sash stops there is a spring biased tumbler or dog that pivots from an unlocked position to a locked position as desired. These sash locks are positioned in the frame of the upper sash and when the tumbler is pivoted outwardly the position of the tumbler prevents the lower sash from being raised above a preselected position. Other prior art patents for similar products are U.S. Pat. Nos. 5,553,903 and 5,806,900 both of which are owned by Ashland.

The typical prior art sash lock operates by a tumbler that is activated by pushing downwardly on the tumbler. The tumbler in the prior art sash locks has a catch portion that contacts the underside of the sash lock housing in a closed position. When the sash lock is intended to be activated, the tumbler is moved in a transverse direction opposite the location of the catch portion to release the catch from the housing. The spring in the sash lock causes the tumbler to be raised into an activated position to lock the sash or door in position.

One of the problems in the operation of the prior art sash locks is that it is frequently difficult for the user to move the tumbler away from the housing to release the tumbler from its recessed position. This is particularly true where the spring that causes the tumbler to be raised is new and/or relatively strong. Many times, the user finds it difficult to maneuver the tumbler away from the housing to release the tumbler. Although many tumblers are provided with surfaces that increase the user's ability to move the tumbler, these surfaces are frequently insufficient to overcome the difficulties of the prior art vent locks.

Similarly, the prior art sash locks can also be difficult to operate when the user wants to release the window or door for travel. The user must not only push down on the tumbler to release the sash but also must shift the tumbler so that it catches the catch portion of the housing. If the catch portion of the housing is not contacted by the tumbler, the tumbler will be raised due to the pressure of the spring and the sash will not be permitted to move.

While the vent stops of the prior art are generally satisfactory in operation there is also a need for improved vent stops. The problems of the prior art stops are solved by the vent stop of the present invention which operates in a unique manner compared to the traditional sash locks.

OBJECTS OF THE INVENTION

It is an object of the present invention to provide a vent stop that operates more easily than the prior art vent stops.

It is an object of the present invention to provide an improved vent stop that is more dependable in its operation than the prior art vent stops.

It is an object of the present invention to provide a vent stop that provides a mechanism that permits the tumbler to be retained in a recessed position more readily than the prior art vent stops.

It is still another object of the present invention to provide a vent stop that is more readily placed in a locking position by a user without having to shift the tumbler away from the catch portion of the housing.

It is a still further object of the present invention to provide a vent stop that has a tumbler that is less likely to become separated from the vent stop housing during use than prior art vent stops.

SUMMARY OF THE INVENTION

The present invention is directed to an improved vent stop or sash lock for use in a sliding sash window assembly or a sliding door assembly. The window may have one or more sashes usually upper and lower sash window frames installed for vertical sliding movement. Alternatively, the window may have left and right horizontal sliding sashes. The door may also have one or more sliding doors. One sash frame or sliding door frame has a recess into the interior thereof. The vent stop has a housing adapted to be disposed in the recess.

This housing includes a cavity with a bottom plate therein. Inside the cavity is a tumbler that may be in a retracted position and an extended position. When the tumbler is in an extended position the tumbler has a protruding apex at the top. The apex prevents a sash or door from moving when the apex contacts the sash or the door. The tumbler has at least one pivot means for pivotally securing said tumbler to said housing for movement between the extended position and the retracted position. In the extended position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into the extended position. The tumbler has at least one means for retaining the tumbler within the housing. The retaining means may be one or more pins that extend laterally from the side of the tumbler and ride within an opening in the sidewall of the housing. Alternatively, the interior wall of the housing may have one or more pins extending toward the tumbler and riding within an opening in the tumbler's side wall.

DETAILED DESCRIPTION OF THE PRESENT INVENTION

Figure 4:
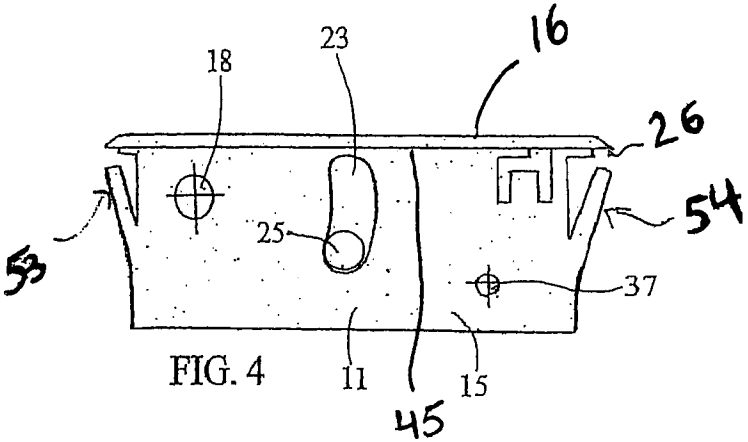
FIG. 4 is a side view of the opposite side of the housing of FIG. 2.
Figure 6:
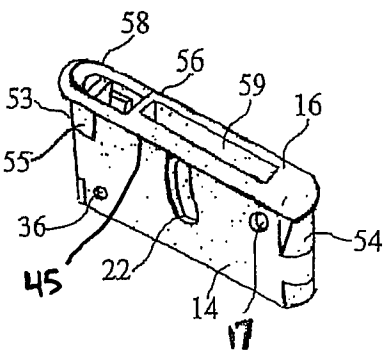
FIG. 6 is a perspective view of the opposite side of the vent stop of FIG. 1.

The window or door assembly that may employ the vent stop of the present invention may be a conventional double hung window, a single hung window, sliding window, sliding door and the like. For convenience the present invention will be described with reference to a double hung window but the same applies to each of the above other types of windows and doors having at least one sliding member. The double hung window usually includes upper and lower sash window frames, that are provided with suitable glazing to protect and bed the glass. The sashes are conventionally mounted within a main jamb frame for vertical reciprocal sliding movement therein. Sliding windows and doors are mounted for horizontal reciprocal sliding. Both the jamb frame and the sashes can be formed of different materials, such as metal or strong and rigid plastics well known in this field. The sashes are preferably fabricated from elongate framing members of hollow configuration and are generally rectangular in cross-section and rectilinear in configuration, but the shapes and configurations can vary. The upper sash includes a stile, and the lower sash includes a header having an upper exterior surface. The vent stop of the present invention is designated generally in FIGS. 1 and 2 by reference numeral 10. This vent stop may be installed in the exterior front surface of the sash stile, engaging the upper exterior surface of the header of the lower sash, in its locking position. It will be appreciated that the vertical location of the vent stop in the stile will depend upon the amount of vertical movement of the lower sash that is desired before the upper header surface engages the vent stop.

Figure 1:
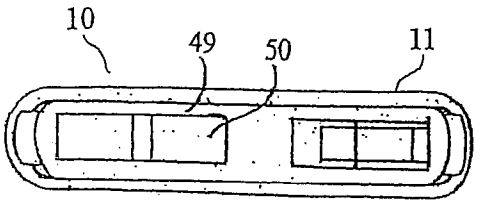
FIG. 1 is a bottom view of the housing of the vent stop of the present invention.
Figure 2:
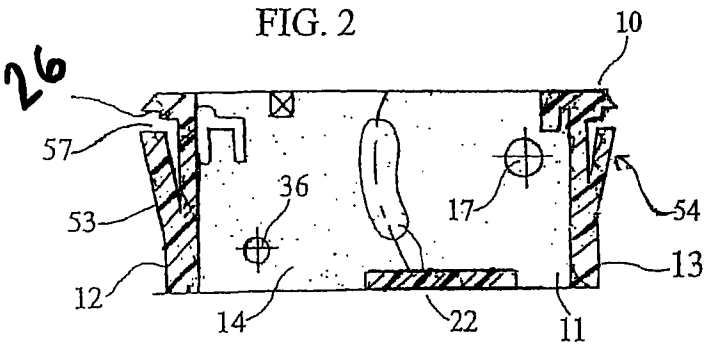
FIG. 2 is a cross-sectional view of the housing of FIG. 1.
Figure 3:
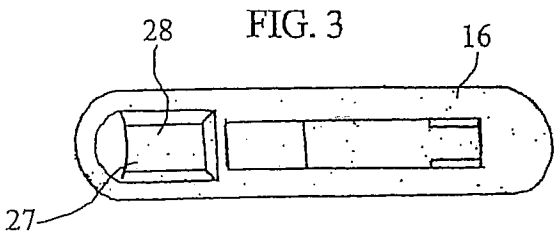
FIG. 3 is a top view of the housing of FIG. 1.
Figure 5:
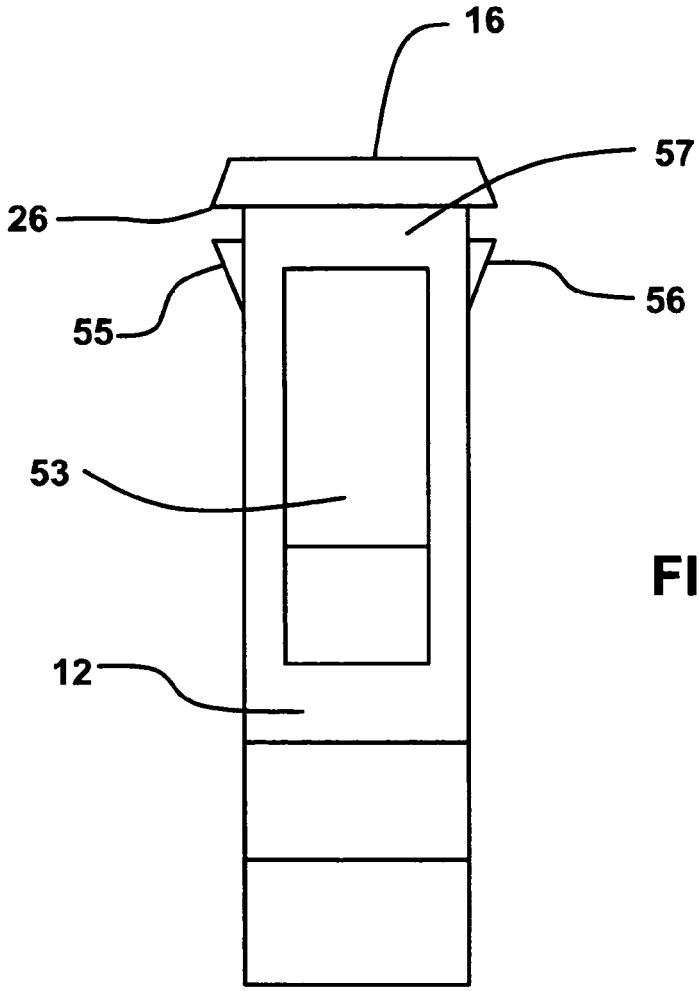
FIG. 5 is an end view of the housing of the vent stop of FIG. 1.
Figure 8:
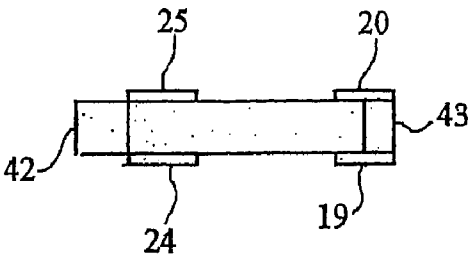
FIG. 8 is a top view of the tumbler of FIG. 7.
Figure 9:
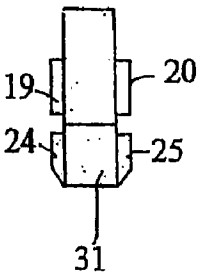
FIG. 9 is an end view of the tumbler of FIG. 7 taken along A-A.
Figure 7:
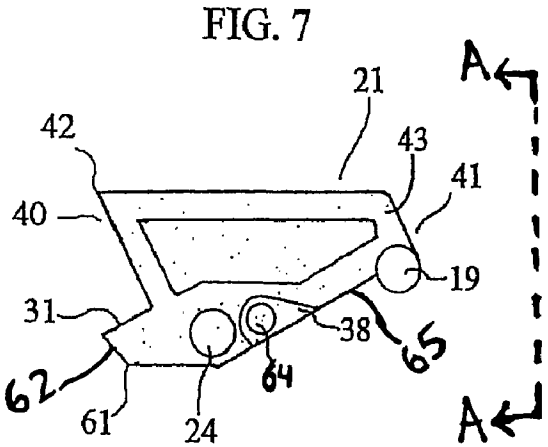
FIG. 7 is a side view of the tumbler of the vent stop of FIG. 1.
Figure 10:
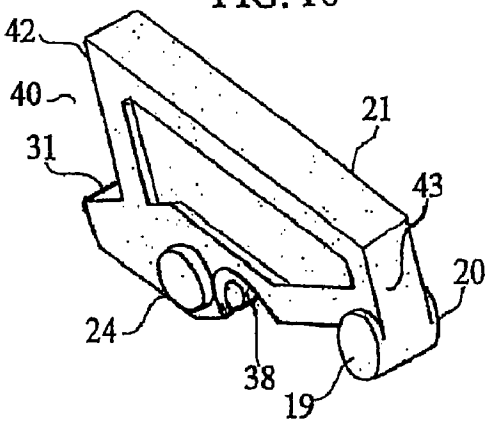
FIG. 10 is a perspective view of the tumbler of FIG. 7.
Figure 11:
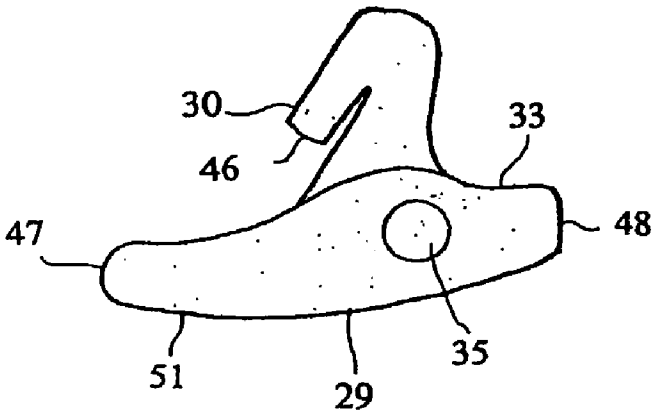
FIG. 11 is a side view of the release mechanism of the vent stop of FIG. 1.
Figure 12:
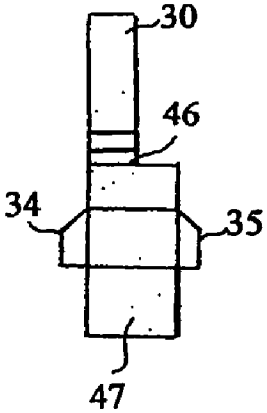
FIG. 12 is an end view of the release mechanism of FIG. 11.
Figure 13:
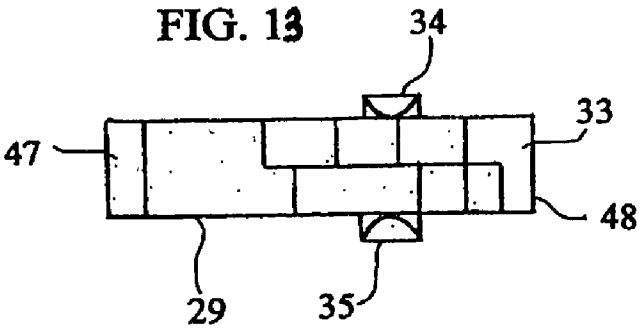
FIG. 13 is a top view of the release mechanism of FIG. 11.
Figure 14:
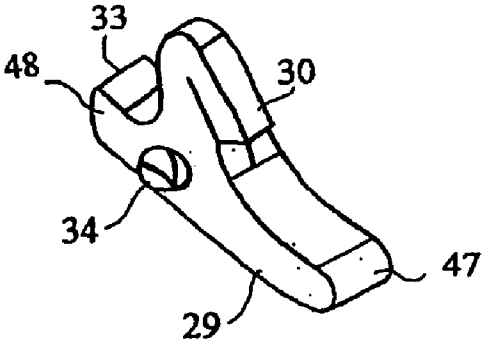
FIG. 14 is a perspective view of the release mechanism of FIG. 11.
Figure 15:
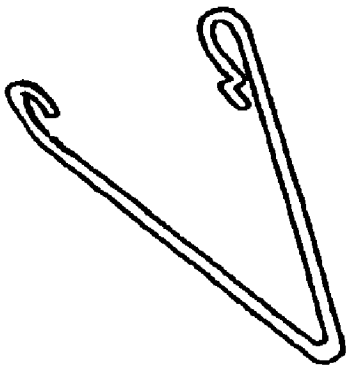
FIG. 15 is a perspective view of the spring of the vent stop of FIG. 1.
Figure 34:
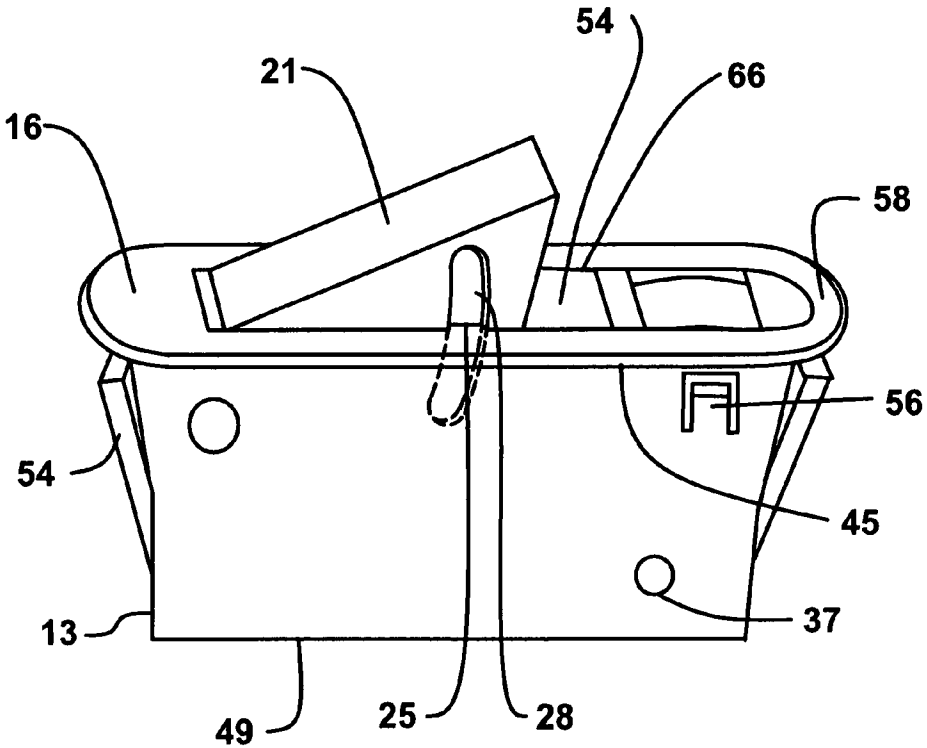
FIG. 34 is a side view of the housing having pivot members.

The vent stop 10 includes a housing 11 shown in FIG. 1 that retains the mechanism of the stop. The housing 11 is installed in an opening or recess in the front surface of the sash stile. The housing 11 may have a front wall 12, rear wall 13 and side walls 14 and 15. On the top surface of the housing is a faceplate 16 which has a lip portion 26 that overlaps the peripheral edge of the recess to support the housing 11 therein and to furnish an attractive exterior appearance and protect any rough edges in the opening in the sash stile. The front wall 12, the rear wall 13 and the side walls 14 and 15 extend downwardly from the lip portion 26 of the faceplate 16. The side walls 14 and 15 are each provided with an opening 17 and 18 respectively for receiving pivot members 19 and 20 on the tumbler 21. It will be appreciated that alternatively, the tumbler 21 may be provided with openings 17 and 18 and the housing with the pivot members 19 and 20 as shown in FIG. 34. Similarly, although the openings 17 and 18 preferably extend completely through the sidewall of the housing they do not have to, provided the opening is deep enough to retain the pivot members in position.

The side walls 14 and 15 of the housing are also provided with recessed tracks 22 and 23. The recessed track is generally in the form of an arc and the track is intended to receive retaining members 24 and 25 that extend from the tumbler 21. The retaining members 24 and 25 typically govern the amount of travel permitted to the tumbler and help retain the tumbler within the housing. As was the case with the openings 17 and 18, the tumbler 21 may alternatively be provided with the recessed tracks 22 and 23. In such embodiment, the interior of the side walls 14 and 15 of the housing may be provided with the retaining members 24 and 25.

Also contained within the housing 11 is the button 27. The button 27 has a top surface 28 that the operator manipulates in operating the vent lock. Typically, the button 27 is pushed inwardly to pivot the release member 29. The pin 32 on the underside of the button 27 contacts the top surface 33 of the release member 29. As the release member 29 pivots, the head 30 moves upwardly thereby releasing the tip 31 of the tumbler 21. When the head 30 rises off of the tip 31, the spring 60 forces the tumbler 21 upwardly into a locking position. The release member 29 is provided with a first pin 34 and a second pin 35 that may be received by orifices 36 and 37 in the sidewalls 14 and 15 of the housing 11.

The tumbler 21 is preferably provided with a recessed portion 38 for receiving one end 39 of the spring 60. The tumbler has a front portion 40 and a rear portion 41. The first tip 31 rises upwardly when the tumbler 21 is released and contacts the underside 45 of the faceplate 16 of the housing 11. The second tip 42 of the front portion 40 extends upwardly above the faceplate 16 of the vent stop housing 11 and prevents the sash from moving while the tumbler 21 is raised. The rear portion 41 of the tumbler has a generally flat surface 43 that contacts tab 44 that extends downwardly from the underside 45 of the faceplate 16. This tab 44 provides additional support to further prevent the tumbler 21 from extending a further distance from the housing 11.

The release member 29 is preferably generally in the shape of an inverted "T". There is a head 30 that is generally in the form of an inverted "U" having a strike surface 46. The release member has a first base end 47 and a second base end 48. On the second base end 48 of the release member 29 is the top surface 33 that is contacted by the pin 32 on the button 27. The release member 29 pivots about pins 34 and 35 which are retained in openings 36 and 37. The underside 49 of the housing 11 is provided with an opening 50 over a portion of its surface. The underside 51 of the release member 29 may extend a short distance below the surface of the underside 49 of the housing 11 when said tumbler 21 is in a lowered position.

The front wall 12 and the rear wall 13 preferably have one or more retaining pins 53 and 54 that extend outwardly from the exterior surface of the housing members. Similarly, the side walls 14 and 15 of the housing 11 may also have one or more retaining pins 55 and 56 extending therefrom. These pins 53-56 are preferably flexible and give slightly to permit the vent stop to be inserted into the opening in the sash. The gap 57 between the underside 45 of the faceplate 16 and the upper surface of pins 53 and 54 is preferably generally about the thickness of the material used in the sash stile or slightly less. The retaining pins are designed so that when the vent stop is snapped into the opening in the sash the pins will retain the vent stop in position and not be removed easily. The faceplate 16 is preferably formed as a solid one piece member and is configured to project only slightly forward of the front surface of the stile so as not to interfere with the relative sliding movement of the sashes. The faceplate 16 may be provided with a curved outer peripheral edge 58, however it will be appreciated that the outer peripheral edge 58 may be any configuration besides curved as is desired.

The faceplate 16 includes a centrally located generally elongate vertical opening 66 which is in communication with an interior cavity 59 of the housing 11. The tumbler 21 is mounted within the cavity 59 to pivot therein and to lockingly engage the upper exterior surface of the lower sash header as the lower sash header is raised.

Figure 16:
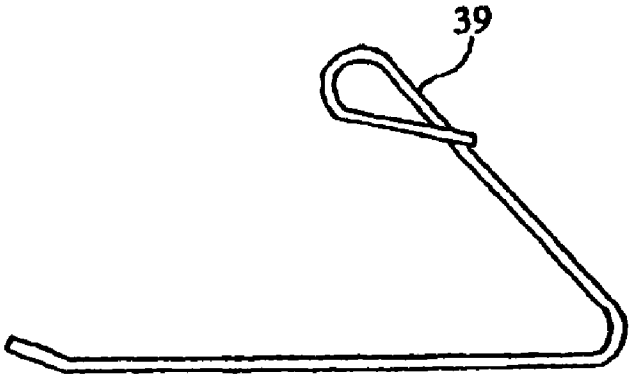
FIG. 16 is a side view of the spring of FIG. 15.
Figure 17:
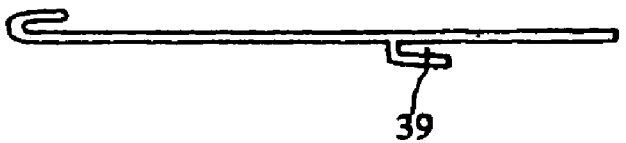
FIG. 17 is a top view of the spring of FIG. 15.
Figure 23:
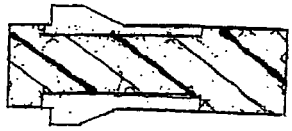
FIG. 23 is a cutaway view of the button of FIG. 18 taken along B-B of FIG. 20.
Figure 19:
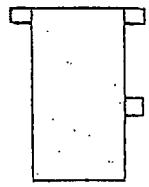
FIG. 19 is a top view of the button of FIG. 18.
Figure 22:
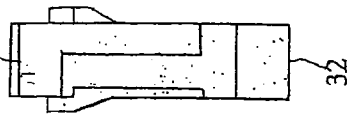
FIG. 22 is an end view of the button of FIG. 18.
Figure 26:
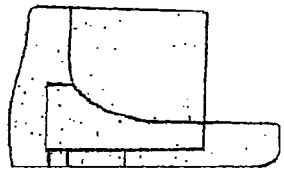
FIG. 26 is a side view of the button of FIG. 18 opposite the side of FIG. 20.
Figure 21:
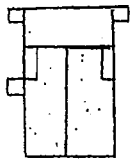
FIG. 21 is a bottom view of the button of FIG. 18.
Figure 25:
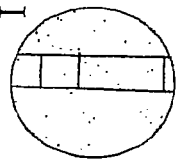
FIG. 25 is an enlarged view of the portion I of FIG. 20.
Figure 18:
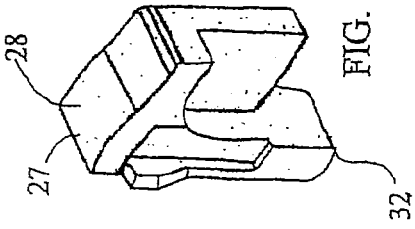
FIG. 18 is a perspective view of the releasing button of the vent stop of FIG. 1.
Figure 20:
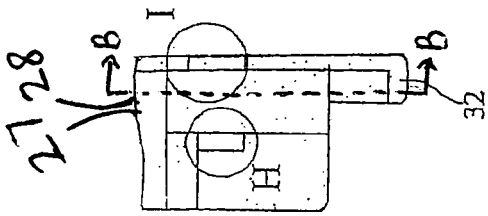
FIG. 20 is a side view of the button of FIG. 18.
Figure 24:
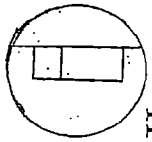
FIG. 24 is an enlarged view of the portion H of FIG. 20.
Figure 28:
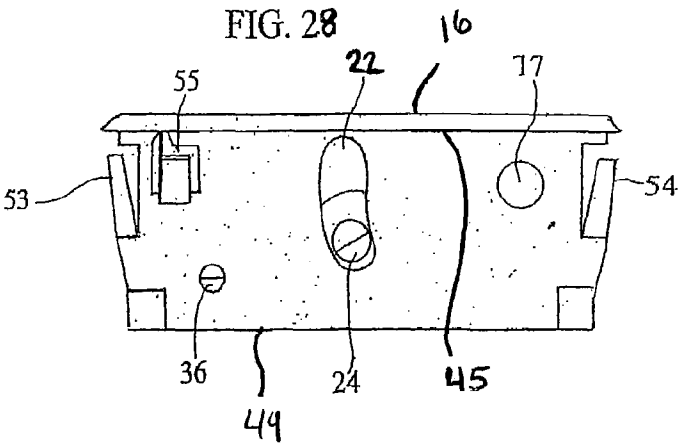
FIG. 28 is a side view of the vent stop of FIG. 27 in solid form.
Figure 30:
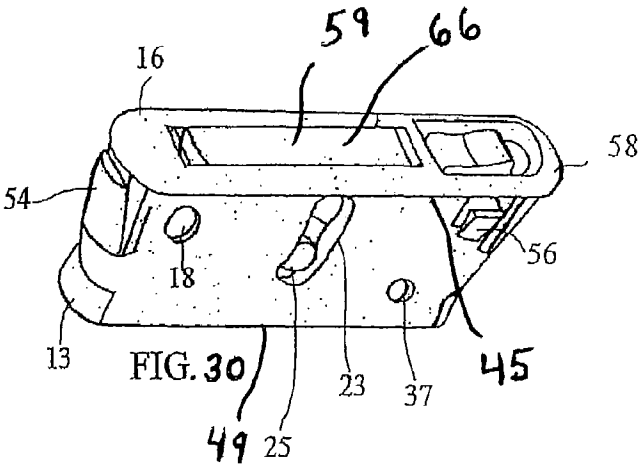
FIG. 30 is a perspective view of the vent stop of FIG. 28.
Figure 27:
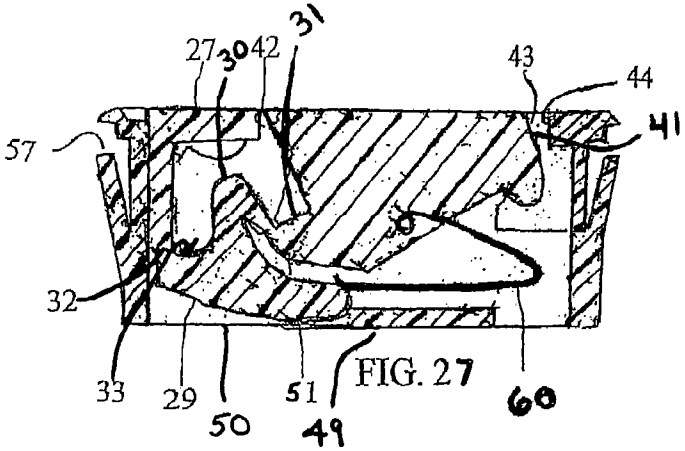
FIG. 27 is a side sectional view of the vent stop of the present invention with the tumbler in a recessed position.
Figure 29:
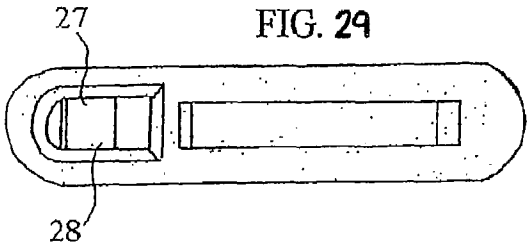
FIG. 29 is a top view of the vent stop of FIG. 28.
Figure 31:
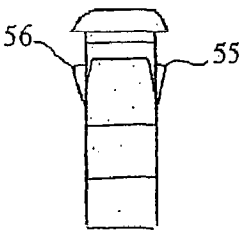
FIG. 31 is an end view of the vent stop of FIG. 28.
Figure 33:
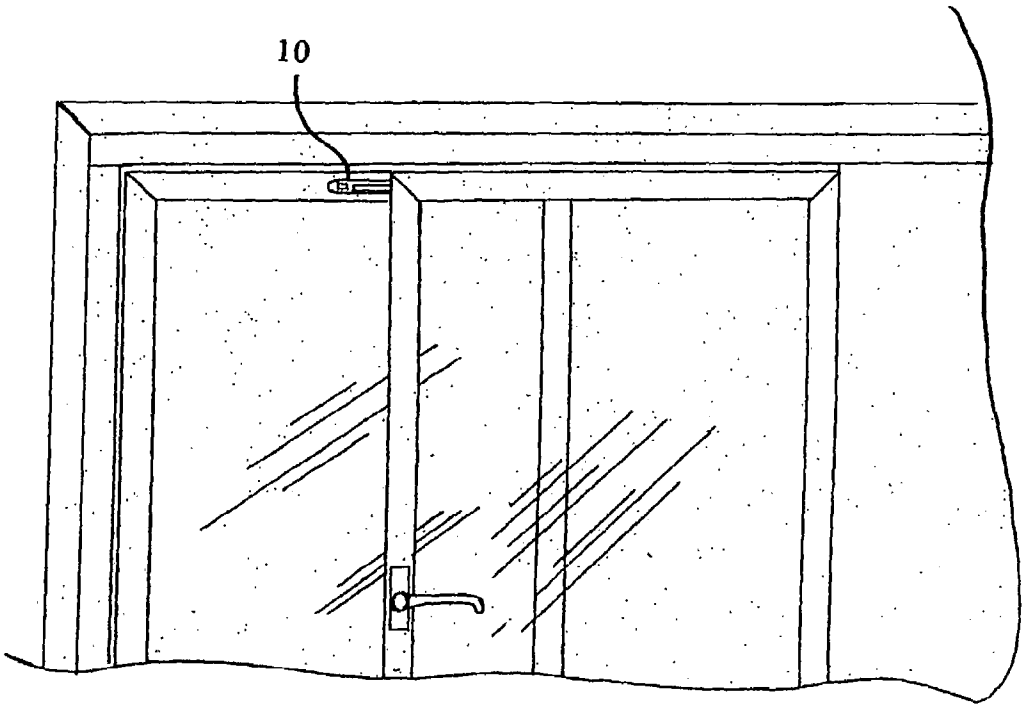
FIG. 33 is an example of the present invention mount on a sliding door.
Figure 32:
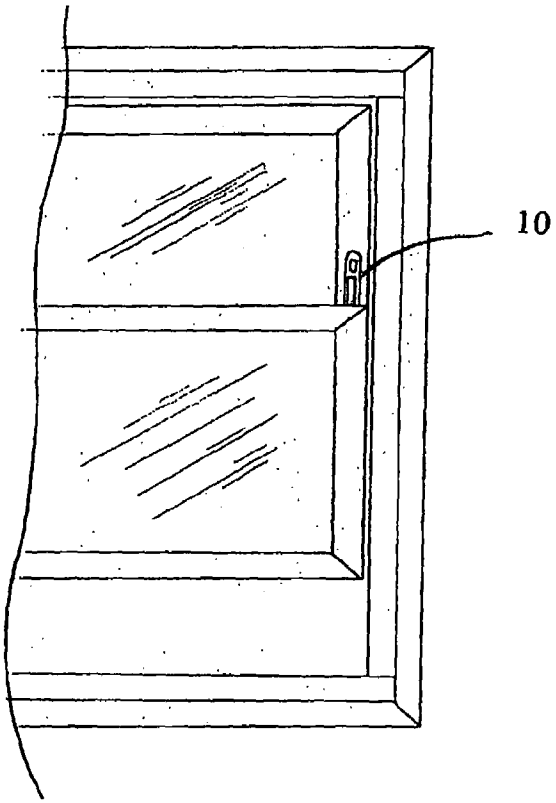
FIG. 32 is an example of the present invention mount on a sliding window.

The tumbler 21 has a bottom surface 61 and a front face 62. The front face 62 is angled as shown in the Figures to permit the tumbler 21 to easily move from an inactivated to an activated position. The spring 60 preferably has a ring 63 that permits the spring 60 to be retained in position by a pin 64 in the underside 65 of the tumbler 21. A preferred type of spring is a leaf spring shown in FIG. 16. However, it will be appreciated by those skilled in the art that other types of springs may be used.

We claim:

1. A vent stop for use with a first sash member and a second sash member, wherein said first sash member slides with respect to said second sash member, wherein the vent stop comprises:

a housing adapted to be disposed in a recess in said second sash member, said housing formed by a face plate, a front wall, a rear wall, and first and second sidewalls, said front and rear walls and said sidewalls extend from said face plate to thereby define a housing cavity;

a tumbler that is pivotally mounted in said housing cavity, said tumbler including an apex which protrudes from said housing cavity when said tumbler is rotated from a retracted position to an extended position; said tumbler further including a recessed portion for receiving an end of a spring which biases the tumbler toward the extended position, where said tumbler is adapted to overlie an edge of said first sash member to prevent movement of said first sash member relative to said second sash member;

a release member that is pivotally mounted in said housing cavity and has a first position which confines said tumbler within said housing cavity when said tumbler is in said retracted position, and a second position which allows said tumbler to rotate out from said housing cavity; said release member having a generally U-shaped head a first base end and a second base end, said base ends extend from said release member pivot point such that said release member is generally "T"-shaped, and wherein said release member includes first and second pins to pivotally mount said release member in said housing cavity; and a button disposed in said housing cavity but having a face exposed through an opening in said face plate of said housing so it is accessible when said housing is disposed in said recess; said button contacting said release member and when pressed, causes said release member to pivot to the second position where said release member no longer restrains said tumbler, and said spring-loaded tumbler rotates to said extended position.

2. A vent stop according to claim 1 wherein said tumbler has a tip which said release member contacts while confining said tumbler within said housing cavity.

3. A vent stop according to claim 2 wherein said button has a pin that contacts a face on said release member when said button is pushed.

4. A vent stop for use with a first sash member and a second sash member, wherein said first sash member slides with respect to said second sash member, wherein the vent stop comprises:

a housing adapted to be disposed in a recess in said second sash member, said housing including a cavity formed by a faceplate and first and second sidewalls;

a tumbler that is pivotally mounted in said housing cavity, said tumbler including an apex which protrudes from said housing cavity when said tumbler is rotated from a retracted position to an extended position; said tumbler further including a recessed portion for receiving an end of a spring which biases the tumbler toward the extended position;

and a release member wherein said release member allows said tumbler to pivot outwardly to said extended position and pivot inwardly to said retracted position; wherein said release member has a head that contacts said tumbler to retain said tumbler in said retraced position when said tumbler is in said retracted position and does not contact said tumbler when said tumbler is in said extended position, said release member also having a first base end and a second base end such that said release member is generally "T"-shaped, and wherein said release member pivots about first and second pins.

5. The vent stop according to claim 4 further comprising at least one retaining member extending from at least one side of said tumbler, wherein said retaining member is received by a recess in one of said sidewalls of said housing.

6. A vent stop for use with a first sash member and a second sash members, wherein said first sash member slides with respect to said second sash member, wherein the vent stop comprises:

a housing adapted to be disposed in a recess in said second sash member, said housing including a cavity formed by a faceplate, a front wall, a rear wall, and first and second sidewalls, wherein said front, rear and sidewalls extend from said faceplate;

a tumbler that is pivotally mounted in said housing cavity, said tumbler including an apex which protrudes from said housing cavity when said tumbler is rotated from a retracted position to an extended position; said tumbler further including a recessed portion for receiving an end of a spring which biases the tumbler toward the extended position, where said tumbler is adapted to overlie an edge of said first sash member relative to said second sash member;

said tumbler further including sides and a pair of protrusions extending from the sides of said tumbler, said protrusions determining said extended position of said tumbler, wherein said protrusions are respectively received by a pair of complementary recessed tracks in said sidewalls;

a release member that is pivotally mounted in said housing cavity and has a first position which confines said tumbler within said housing cavity when said tumbler is in said retracted position, and a second position which allows said tumbler to rotate out from said housing cavity; said release member having a head, a first base end and a second base end, said base ends extend from said release member pivot point such that said release member is generally "T"-shaped, and wherein said release member includes first and second pins which pivotally mount said release member in said housing; and a button accessible through the faceplate of said housing so it is accessible when said housing is disposed in said recess, when said button is pressed in a direction perpendicular to a plane defined by said faceplate, said button moves said release member from said first position to said second position thereby allowing said tumbler to pivot to said extended position.

7. A vent stop according to claim 6 wherein said tumbler has a tip which said release member contacts while confining said tumbler within said housing cavity.

8. A vent stop according to claim 7 wherein said button has a pin that contacts a face on said release member when said button is pushed.

9. A vent stop according to claim 7 wherein said tumbler can be moved to said retracted position without depressing the button.

10. A vent stop for use with a first sash member and a second sash member, wherein said first sash member slides with respect to said second sash member, wherein the vent stop comprises:

a housing adapted to be disposed in a recess in said second sash member, said housing formed by a faceplate, a front wall, a rear wall, and first and second sidewalls, wherein said front, rear and sidewalls extend from said faceplate to define a cavity;

a tumbler that is pivotally mounted in said housing cavity, said tumbler including an apex which protrudes from said housing cavity when said tumbler is rotated from a retracted position to an extended position, where said tumbler is adapted to overlie;

an edge of said first first sash member relative to said second sash member;

a spring for biasing said tumbler toward said extended position;

a release member that is pivotally mounted in said housing cavity and has a first position which confines said tumbler within said housing cavity when said tumbler is in said retracted position, and a second position which allows said tumbler to rotate from said retracted position to said extended position; said release member having a generally U-shaped head, a first base end and a second base end, said base ends extend from said release member pivot point such that said release member is generally "T"-shaped, and wherein said release member includes first and second pins which pivotally mount said release member in said housing; and a button disposed in said housing cavity but having a face exposed through an opening in said faceplate of said housing so it is accessible when said housing is disposed in said recess; said button contacting said release member and when pressed in a a plane defined by the faceplate, said button second position where said release member no longer restrains said tumbler, and said spring-loaded tumbler rotates to said extended position; said tumbler may be returned to the retracted position by pressing said tumbler into said housing, without said button being pressed.

11. A vent stop according to claim 10 wherein said tumbler has a ledge which said release member contacts while confining said tumbler within said housing cavity.

12. A vent stop according to claim 11 wherein said button has a pin that contacts a face on said release member when said button is pushed.

13. A vent stop for use with a first sash member and a second sash member, wherein said first sash member slides with respect to said second sash member, wherein the vent stop comprises:

a housing adapted to be disposed in a recess in said second sash member, said housing formed by a faceplate, a front wall, a rear wall, and first and second sidewalls, said front and rear walls and said sidewalls extend from said faceplate to define a housing cavity;

a tumbler that is pivotally mounted in said housing cavity, said tumbler including an apex which protrudes from said housing cavity when said tumbler is rotated from a retracted position to an extended position; said tumbler further including a recessed portion for receiving a spring which biases the tumbler towards the extended position; and a release member wherein said release member allows said tumbler to pivot outwardly to said extended position and pivot inwardly to said retracted position; wherein said release member has a head that contacts said tumbler to retain said tumbler in said retracted position when said tumbler is in said retracted position and does not contact said tumbler when said tumbler is in said extended position; said release member also having a first base end and a second base end which, along with said head, roughly form a "T"-shape and wherein said release member pivots about first and second pins.

14. The vent stop according to claim 13 wherein said tumbler further comprises a pair of recessed tracks, wherein said recessed tracks mesh with a pair of complementary protrusions on the first and second sidewalls of the housing.

15. A vent stop for use with a first sash member and a second sash member, wherein said first sash member slides with respect to said second sash member, wherein the vent stop comprises:

a housing adapted to be disposed in a recess in said second sash member, said housing formed by a face plate, a front wall, a rear wall, and first and second sidewalls, said front and rear walls and said sidewalls extending from said face plate to define a housing cavity;

a tumbler that is pivotally mounted in said housing cavity, said tumbler including an apex which protrudes from said housing cavity when said tumbler is rotated from a retracted position to an extended position; said tumbler further including a recessed portion for receiving an end of a spring which biases the tumbler toward the extended position, where said tumbler is adapted to overlie an edge of said first sash first sash member relative to said second sash member;

a release member that is pivotally mounted in said housing cavity and has a first position in which said release member confines said tumbler in said housing cavity when said tumbler is in said retracted position; said release member having a first base end, a second base end, and a head whereby said release member is generally T-shaped, wherein said head engages said tumbler when said tumbler is in said retracted position and said release member is in said first position and does not contact said tumbler when said tumbler is in said extended position and wherein said release member includes first and second pins to pivotally mount said release member in said housing.

16. A vent stop according to claim 15 further comprising a button, disposed adjacent the face plate of said housing so it is accessible when said housing is disposed in said recess, wherein when said button is pressed inwardly, said button causes said release member to move from said first position to a second position thereby allowing said tumbler to move from said retracted position to said extended position.

17. A vent stop for use with a first sash member and a second sash member, wherein said first sash member slides with respect to said second sash member, wherein the vent stop comprises:

a housing adapted to be disposed in a recess in said second sash member, said housing formed by a face plate, a front wall, a rear wall, and first and second sidewalls, said front and rear walls and said sidewalls extending from said face plate, which thereby define a housing cavity;

a tumbler that is pivotally mounted in said cavity, said tumbler including an apex which protrudes from said housing cavity when said tumbler is rotated from a retracted position to an extended position; said tumbler further including a recessed portion for receiving an end of a spring which biases the tumbler toward the extended position, where said tumbler is adapted to overlie an edge of said first sash member to prevent movement of said first sash member relative to said second sash member;

a release member that is pivotally mounted in said housing cavity and has a first position which confines said tumbler within said housing cavity when said tumbler is in said retracted position, said release member having a first base end and a second base end, and a head whereby said release member is generally "T"-shaped and wherein said release member includes first and second pins which pivotally mount said release member on said housing; and and a button which when pressed causes said release member to move from said first position to a second position thereby allowing said tumbler to move from said retracted position to said extended position.

18. A vent stop according to claim 17 wherein said end of said spring has a ring which receives a protrusion of tumbler.

* * * * *